US007585444B2

(12) United States Patent
Baranowske, III et al.

(10) Patent No.: US 7,585,444 B2
(45) Date of Patent: Sep. 8, 2009

(54) METHOD FOR REDUCING CAMBER IN COILED PLASTIC RIBBON OR TAPE

(75) Inventors: Carroll F. Baranowske, III, Tomkins Cove, NY (US); Rusty Koenigkramer, Nanuet, NY (US); Hugh K. Schedler, Park Ridge, NJ (US); Carolyn Cannan, legal representative, Park Ridge, NJ (US)

(73) Assignee: Illinois Tool Works Inc., Glenview, IL (US)

( * ) Notice: Subject to any disclaimer, the term of this patent is extended or adjusted under 35 U.S.C. 154(b) by 825 days.

(21) Appl. No.: 11/152,271

(22) Filed: Jun. 14, 2005

(65) Prior Publication Data

US 2006/0279016 A1 Dec. 14, 2006

(51) Int. Cl.
*B29C 47/00* (2006.01)
*B65H 18/00* (2006.01)

(52) U.S. Cl. ..... 264/177.17; 264/281; 242/471; 242/477.1

(58) Field of Classification Search ..... 242/471, 242/477.1, 419.1, 471 X; 264/177.17, 281
See application file for complete search history.

(56) References Cited

U.S. PATENT DOCUMENTS 3,207,827 A * 9/1965 Kuehnle ..... 264/171.16
4,060,207 A * 11/1977 Miyazaki et al. ..... 242/476.7
4,204,653 A * 5/1980 Nose et al. ..... 242/178
4,354,342 A * 10/1982 Rumsey et al. ..... 57/119
4,489,901 A * 12/1984 Andersen ..... 242/471
4,835,835 A 6/1989 Gould
5,024,537 A 6/1991 Tilman
5,065,899 A 11/1991 Tilman
5,071,689 A 12/1991 Tilman
5,240,781 A * 8/1993 Obata et al. ..... 428/32.79
5,242,516 A * 9/1993 Custer et al. ..... 156/66
5,709,488 A * 1/1998 Imai et al. ..... 400/234
5,947,410 A * 9/1999 Christie ..... 242/615.1
5,971,313 A * 10/1999 Krayenhagen ..... 242/417.3
6,095,449 A * 8/2000 Gallo et al. ..... 242/365.4
6,343,763 B1 * 2/2002 Fleury et al. ..... 242/471
6,443,386 B1 * 9/2002 Bednarczyk et al. ..... 242/478.2
6,609,353 B1 8/2003 McMahon et al.
6,616,881 B2 9/2003 Machacek
6,656,104 B1 * 12/2003 Forrester et al. ..... 493/459
6,808,666 B2 10/2004 Fukumori et al.
6,902,131 B1 * 6/2005 Jelinek et al. ..... 242/413.5

FOREIGN PATENT DOCUMENTS

EP 447720 A1 * 9/1991

* cited by examiner

*Primary Examiner*—Joseph S. Del Sole
*Assistant Examiner*—Kimberly A Stewart
(74) *Attorney, Agent, or Firm*—Ostrager Chong Flaherty & Broitman P.C.

(57) ABSTRACT

A method of winding a length of plastic ribbon (such as a zipper of the type used in reclosable packaging) around a cylinder of a spool having a first flange at one end and a second flange at the other end, comprising the following steps: (a) winding the ribbon with a winding tension in a first range when the portion of the ribbon being wound is within a first volume surrounding a central region of the cylinder; and (b) winding the ribbon with a winding tension in a second range when the portion of the ribbon being wound is within second and third volumes surrounding respective portions of the cylinder disposed between the central region and the first and second flanges respectively. To reduce camber in the portions of the wound ribbon disposed in the second and third volumes, i.e., near the respective spool flanges, the upper limit of the second range of winding tension is less than the lower limit of the first range of winding tension, i.e., the winding tension near the spool flanges is less than the winding tension in the central region.

19 Claims, 2 Drawing Sheets

METHOD FOR REDUCING CAMBER IN COILED PLASTIC RIBBON OR TAPE

BACKGROUND OF THE INVENTION

This invention generally relates to methods for reducing or eliminating camber (i.e., arching) in wound or coiled ribbon or tape made of plastic material. In particular, the invention relates to methods for reducing or eliminating camber in a fastener tape comprising mutually interlocked thermoplastic zipper strips of the type used in the automated production of reclosable packaging.

In accordance with one manner of producing reclosable packaging, a pair of mutually interlockable zipper strips are formed separate from and then attached to a web of bag making or package making material. The zipper strips are attached to the film web using automated equipment. The feeding of zipper strips from rolls or spools for application in whatever length desired to bag making or package making sheet material is well known in the art.

A major problem with rolled or spooled extruded plastic zipper strips is that they develop curvature and camber. Winding of any flexible plastic extrusion in whatever configuration inherently distorts straightness of the finished product, which is visible when the strips are removed from the spool or reel. This is almost an inevitable result of the winding systems employed which, irrespective of taper, tension or torque winding, require that sufficient tension be applied to the extruded product to ensure accurate placement of that product on the spool or reel. As a result, the extruded product is in a state of flux in that it has not achieved its final fully crystallized condition before being wound due to production speed requirements. Therefore, in the extruded wound product, malleable condition stresses and strains are set into the product. As the strips are wound, subsequent shrinkage takes place over a period of time. The shrinkage virtually ensures that irrespective of the type of winding or plastic material used, the strips will tighten down to an increased degree around the spool circumference. For example, if a length of extruded plastic zipper strip were laid out on a floor, it would shrink at a known rate provided that both ends of the product are not trapped. The same length of zipper strip, when wound onto a spool and trapped on either end, cannot shrink over a period of time. Therefore, the strip has locked-in stress and strain that cannot be relieved.

In the case of extruded plastic flanged zipper strips of the type used in the automated production of reclosable packaging, a pair of interlocked zipper strips are wound or coiled on a flanged spool with the zipper flanges disposed generally parallel to the surface of the spool cylinder. Such interlocked flanged zipper strips, when unwound or paid out from the spool, typically have some degree of camber. As used herein, the term "camber" refers to the arching of the interlocked flanged zipper strips in a plane generally parallel to the zipper flanges. In other words, even when the interlocked zipper strips are unwound and cut into zipper segments, the zipper segments (when placed on a planar surface with one flange in contact with that surface) will have varying degrees of arching in the horizontal plane (as seen in FIG. 2, described hereinafter).

The deviation from a straight line or warpage in the extruded plastic zipper strips that results from being wound on a spool can cause problems when the zipper strips are cut into segments and those zipper segments are attached to a web of package making material. In most cases, it is desirable that the zipper strips be substantially straight during the zipper-to-web joining operation. In accordance with known methods of applying zipper strips to a web of package making material (e.g., transverse application of zippers on a vertical form-fill-seal machine or zipper application on a horizontal pre-made bag machine), the zipper strips are kept under tension in order to minimize the difficulty in applying the otherwise cambered zipper strips to the web. In cases where zero deviation from straightness is required, the zippers trips must be held under extreme tension. In applications where the zipper strips cannot be held under tension, application of the zipper strips to the packaging material is virtually unattainable.

A further complication arises from the fact that in many cases, the amount of camber in the wound fastener ribbon or tape varies as a function of the axial position of the cambered portions on the spool. In those cases, it has been observed that the ribbon portions wound in the regions adjacent the spool flanges have more camber than the ribbon portions wound in a central region of the spool. This may be attributable in part to the fact that in the central region, the fastener ribbon is wound generally helically, whereas in the vicinity of the flanges the helical winding of the fastener ribbon reverses direction. If a rotating mechanism is used to drive the travel of the winding portion of the ribbon or tape back and forth across the spool, at each spool flanges the rotating mechanism must hesitate while it reverses direction. When the rotating mechanism hesitates, the tension in the wound ribbon or tape tends to increase, which also contributes to the creation of camber in those portions of the ribbon or tape wound in the vicinity of the spool flanges.

There is a need for a method of winding plastic ribbon on a spool in a manner that reduces the degree of ribbon camber near the spool flanges.

BRIEF DESCRIPTION OF THE INVENTION

The present invention is directed to a method for reducing camber in a wound plastic ribbon such as a plastic fastener tape of the type used in the automated production of reclosable packaging. More specifically, the disclosed method reduces camber in those portions of the plastic ribbon that are wound on the spool in the spaces adjacent the spool flanges by reducing the winding tension during winding of those portions.

One aspect of the invention is a method of winding a length of plastic ribbon around a cylinder of a spool having a first flange at one end and a second flange at the other end, the first and second flanges being separated by a spool length, comprising the following steps: (a) winding the ribbon with a winding tension in a first range when the portion of the ribbon being wound is within a first predetermined distance of the first flange; (b) winding the ribbon with a winding tension in the first range when the portion of the ribbon being wound is within a second predetermined distance of the second flange; and (c) winding the ribbon with a winding tension in a second range when the portion of the ribbon being wound is not within a first predetermined distance of the first flange and not within a second predetermined distance of the second flange, wherein the sum of the first and second predetermined distances is less than the spool length, and the upper limit of the first range of winding tension is less than the lower limit of the second range of winding tension.

Another aspect of the invention is a method of winding a length of plastic ribbon around a cylinder of a spool having a first flange at one end and a second flange at the other end, comprising the following steps: (a) winding the ribbon with a winding tension in a first range when the portion of the ribbon being wound is within a first volume surrounding a central region of the cylinder; (b) winding the ribbon with a winding tension in a second range when the portion of the ribbon being wound is within a second volume surrounding a portion of the cylinder disposed between the first flange and the central region; and (c) winding the ribbon with a winding tension in the second range when the portion of the ribbon being wound is within a third volume surrounding a portion of the cylinder disposed between the second flange and the central region, wherein the lower limit of the first range of winding tension is greater than the upper limit of the second range of winding tension.

A further aspect of the invention is a method of winding a length of plastic ribbon around a cylinder of a spool having a first flange at one end and a second flange at the other end, comprising the following steps: (a) attaching an end of the ribbon to the spool so that a portion of the ribbon is disposed at a starting position on the cylinder; (b) rotating the spool with the end of the ribbon attached thereto; (c) while the spool is rotating, continuously displacing one of the incoming portion of the ribbon and the spool relative to the other so that the most recently wound portion of the ribbon moves relative to the spool from the starting position toward the first flange, such displacement continuing until the most recently wound portion of the ribbon is located adjacent or near the first flange; (d) following step (c) and while the spool is rotating, continuously displacing one of the incoming portion of the ribbon and the spool relative to the other so that the most recently wound portion of the ribbon moves relative to the spool from the first flange toward the second flange, such displacement continuing until the most recently wound portion of the ribbon is located adjacent or near the second flange; (e) following step (d) and while the spool is rotating, continuously displacing one of the incoming portion of the ribbon and the spool relative to the other so that the most recently wound portion of the ribbon moves relative to the spool from the second flange toward the first flange, such displacement continuing until the most recently wound portion of the ribbon is located adjacent or near the first flange, wherein steps (d) and (e) are repeated in alternating sequence during winding, and further comprising the following steps: whenever the most recently wound portion of the ribbon is within a central region and not within a predetermined distance of either of the first and second flanges during steps (c), (d) and (e), maintaining the tension in the incoming portion of the ribbon within a first range; and whenever the most recently wound portion of the ribbon is within the predetermined distance of either of the first and second flanges during steps (c), (d) and (e), maintaining the tension in the incoming portion of the ribbon within a second range, the upper limit of the second tension range being less than the lower limit of the first tension range.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

For the purpose of illustration, a method of winding extruded plastic ribbon in accordance with one embodiment of the invention will be described with reference to the fastener tape profile shown in the sectional view of FIG. 1. This exemplary fastener tape is of a type that can be wound on a spool for storage or transport and then unwound and fed to a form-fill-seal machine. It should be appreciated, however, that the present invention has application to not only extruded plastic fastener tapes having structures different than that shown in FIG. 1, but also to extruded plastic ribbons or tapes other than fastener tapes used in automated manufacture of reclosable packaging.

Figure 1:
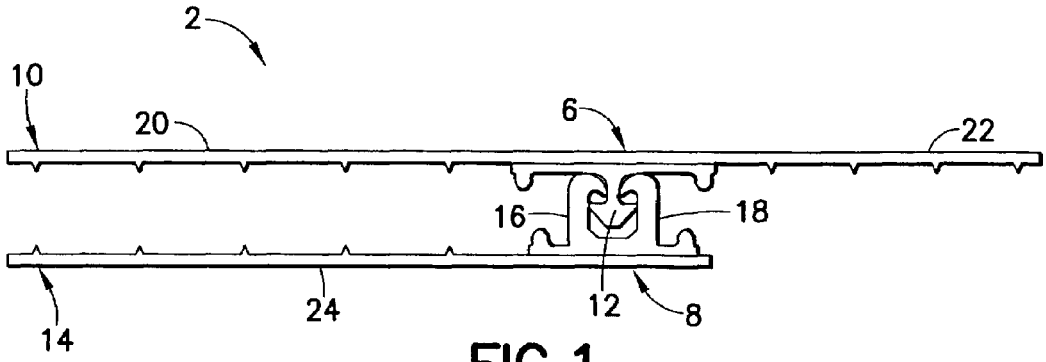
FIG. 1 is a drawing showing a sectional view of an exemplary fastener tape that can be wound on a spool for storage or transport and then unwound and fed to a form-fill-seal machine. The invention has application to the winding of the fastener tape partly depicted in FIG. 1 as well as extruded plastic fastener tapes having different structures.

FIG. 1 depicts the cross section of a fastener tape 2 comprising a pair of extruded zipper strips 6 and 8 of the rib and groove variety. The zipper strip 6 comprises a base web 10 and a closure element 12 having a male profile and joined to and supported by the base web 10. The male profile is a truncated arrowhead having a pair of detents projecting laterally outward on opposite sides. The zipper strip 8 comprises a base web 14 and a closure element having a female profile and joined to and supported by the base web 14. The female profile comprises a pair of hook-shaped jaws 16 and 18 having respective detents that latch behind the detents of the male profile in the interlocked state depicted in FIG. 1. The base web 10 is longer than the base web 14 and comprises a pull flange 20 and an extension flange 22. The base web 14 comprises a pull flange 24 and no extension flange. The small spaced projections on the inner surfaces of the base webs 10 and 14 represent parallel ribs that facilitate the consumer gripping the pull flanges 20 and 24 and pulling them apart when a segment of the fastener tape has been incorporated in a reclosable package. In that event, the pull flanges will be pulled apart until the male and female profiles have been disengaged, thereby opening the zipper.

Although the internal structure of the base webs 10 and 14 is not depicted in FIG. 1, each base web is a laminate comprising an inner layer made of a thermoplastic material that melts at a relatively high temperature and an outer layer made of a thermoplastic material (i.e., a so-called "sealant" material) that melts at a relatively low temperature, thereby facilitating the joinder of the base webs to the web of packaging material by conventional conductive heat sealing without melting of the inner "non-sealant" layer. As used herein, the term "zipper strip" is broad enough in meaning to include an extruded profiled plastic strip with or without a sealant layer.

It is known to wind a length of a fastener tape having the structure shown in FIG. 1 on a flanged spool for storage or transport. After the fastener tape has been wound on the spool, the spool can be brought to the site of an FFS or other packaging machine, where the fastener tape is continuously unwound from the spool and fed to a zipper application station. In accordance with past practice, the segments cut from the unwound fastener tape invariably had some amount of camber, with the segments cut from portions of the fastener tape unwound from the regions near the spool flanges having more camber than the segments cut from portions of the fastener tape unwound from a central region of the spool.

Figure 2:
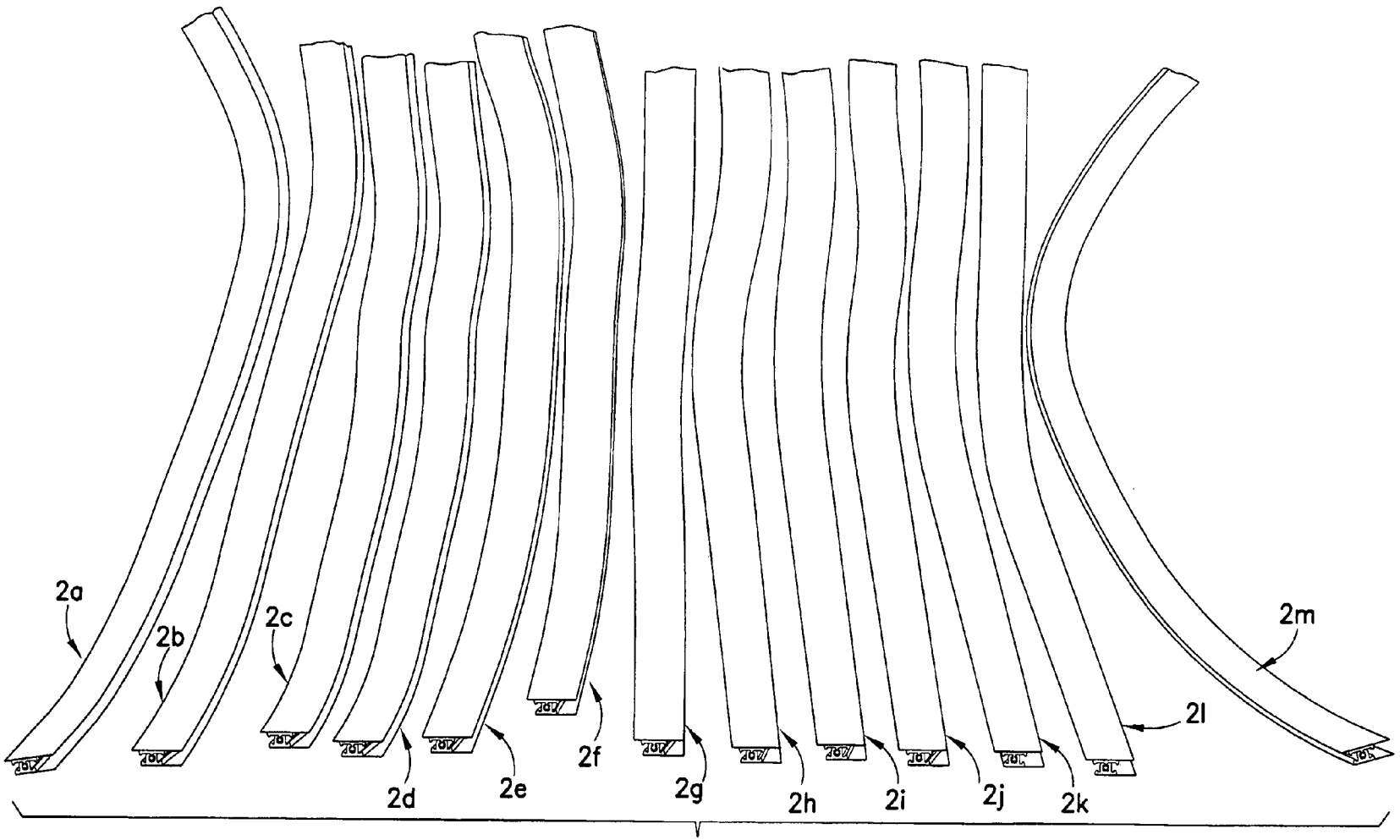
FIG. 2 is a drawing based on a photograph that shows the various degrees of camber in a plurality of zipper samples cut from a fastener tape after unwinding from a spool, the samples being arrayed in accordance with their axial position on the spool, with the leftmost and rightmost samples being having been located on the spool near the respective spool flanges. Each of the actual samples in the photograph had the same cross-sectional profile as that shown in FIG. 1.

FIG. 2 is a drawing based on a photograph taken of a plurality of zipper segments 2*a* through 2*m* cut from a fastener tape of the type depicted in FIG. 1 after unwinding from a spool. At the time when the photograph was taken, the sample zipper segments were lying on a horizontal surface. The photograph was taken at an angle from a position forward of (not directly over) the zipper segments. Therefore the drawing shows in essence a perspective view.

The zipper segments 2*a*-2*m* are arrayed in FIG. 2 in accordance with their relative axial positions on the spool, with the leftmost zipper segment 2*a* having been located near one spool flange and the rightmost zipper segment 2*m* having been located near the other spool flange. The zipper segments 2*a* and 2*m* have the greatest amount of camber. All of the other segments show some amount of camber, with the possible exception of zipper segment 2*g*, which appears to be almost straight.

Figure 3:
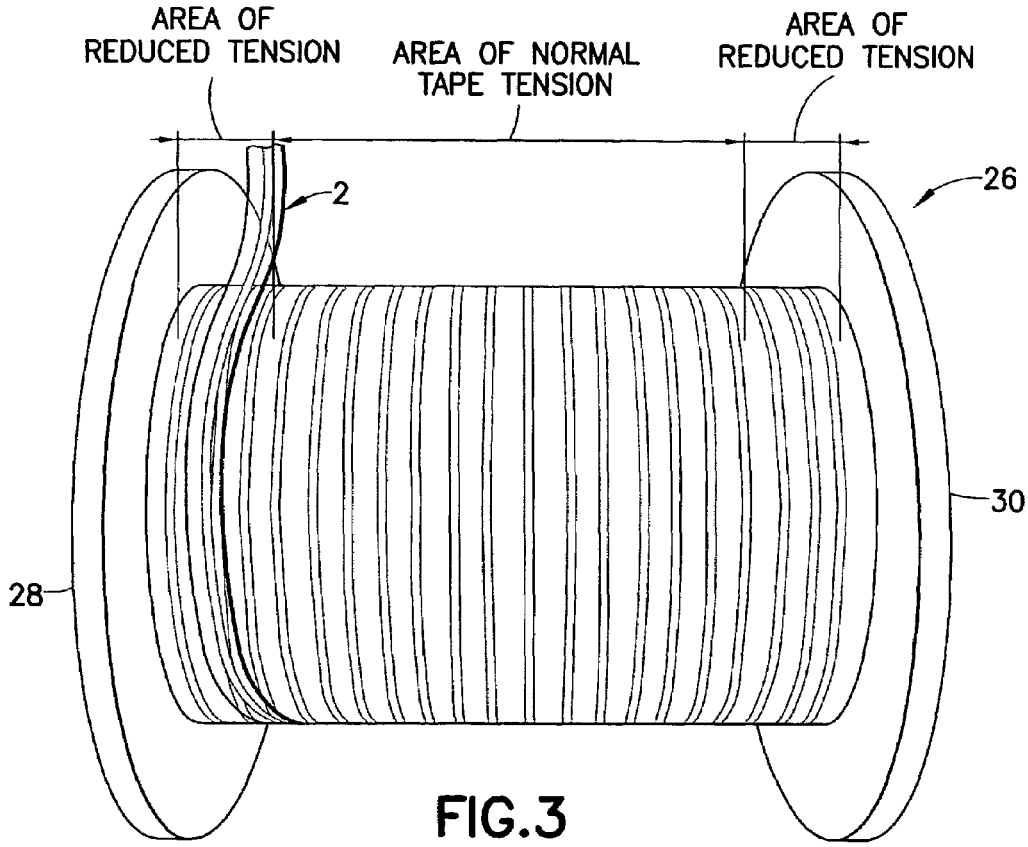
FIG. 3 is a drawing showing an isometric view of fastener tape being wound on a spool. The areas of reduced winding tension and an area of normal winding tension are indicated by arrows and vertical lines.

The method disclosed herein seeks to reduce the amount of camber in the portions of a fastener tape wound on a spool in the regions adjacent the spool flanges by reducing the winding tension in those regions relative to the winding tension employed in a central region of the spool. The winding operation in accordance with one embodiment of the invention is depicted in FIG. 3. A fastener tape 2 is shown partly wound around a circular cylindrical drum or core (not visible) of a spool 26. The spool 26 comprises first and second annular spool flanges 28 and 30 that project radially outward from opposite ends of the core. The flanges 28 and 30 respectively establish the limit positions for the wound fastener tape at respective ends of the spool.

In a conventional fastener tape winder, it is well known to provide a reciprocating zipper guide (not shown in FIG. 3), through which the fastener tape is threaded on its way to being wound on the spool. The zipper guide may be mounted to a platform that is fixed to a nut, which nut is in turn coupled to a lead screw driven by a servo motor (not shown). The rotational axis of the lead screw is preferably generally parallel to the rotational axis of the spool. Starting initially with the zipper guide being positioned at a first limit position near one spool flange, as the lead screw rotates in a first direction, the zipper guide displaces axially from the first limit position toward a second limit position near the other spool flange. When the lead screw stops rotating in the first direction, the zipper guide hesitates at the second limit position while the spool continues to rotate. The lead screw is then rotated in the opposite direction, causing the zipper guide to again traverse the spool from flange to flange, but traveling in the opposite direction. These operations are performed repeatedly to cause the zipper guide to traverse back and forth across the rotating spool. As the zipper guide moves, it changes the position where the tensioned fastener tape is being wrapped onto the spool drum.

During the winding operation, the spool 26 is driven to rotate at varying speeds by conventional means (not shown). As the spool rotates, incremental incoming portions of the fastener tape 2 are wrapped under tension around the rotating drum, with the not yet wrapped portion of the fastener tape being stretched under tension while being pulled by the rotating drum. The tension of the wrapped portion of the fastener tape for a given turn is a function of the speed at which the fastener tape is being pulled through the zipper guide. The tape speed in turn is a function of the rotational speed of the spool and the outer diameter of the coil of fastener tape in the area where the wrapped portion contacts the coil.

In accordance with one embodiment of the present invention, the tension in the wound fastener tape is varied as a function of the axial position of the winding portion of the fastener tape as the latter traverses back and forth between the flanges. When the fastener tape 2 is being wound on a central area of the spool drum (indicated by the double-headed arrow labeled "Area of Normal Tape Tension"), the tape is wound with a normal amount of tension. When the fastener tape 2 is being wound in an area near the spool flange 28 (indicated by a pair of vertical lines on the left-hand side of FIG. 3), the tape is wound with an amount of tension that is less than the aforementioned normal tension. Similarly, when the fastener tape 2 is being wound in an area near the spool flange 30 (indicated by a pair of vertical lines on the right-hand side of FIG. 3), the tape is wound with an amount of tension that is less than the aforementioned normal tension. The areas of reduced tension in the vicinities of the spool flanges help to reduce the degree of camber of those portions of the fastener tape when they are unwound from the spool during automated manufacture of reclosable packages.

More specifically, the method of winding comprises the following steps. To start, an end of the fastener tape 2 must be threaded through the zipper guide and then attached to the spool 26 so that a portion of the fastener tape is disposed at a starting position on the spool drum. To begin winding the tape, the spool 26 is then rotated with the end of the fastener tape attached thereto. While the spool is rotating, the incoming portion of the fastener tape 2 is continuously displaced relative to the spool by the axially traversing zipper guide, so that the most recently wound portion of the fastener tape moves from the starting position toward, e.g., the spool flange 28, such displacement continuing until the most recently wound portion of the fastener tape 2 is located adjacent or near the spool flange 28. At or near the spool flange 28, the zipper guide hesitates while the spool 26 continues to rotate. Then the zipper guide moves in the opposite direction, continuously displacing the incoming portion of the fastener tape 2 relative to the spool, so that the most recently wound portion of the fastener tape moves from the spool flange 28 toward the spool flange 30, such displacement continuing until the most recently wound portion of the fastener 2 tape is located adjacent or near the spool flange 30. At or near the spool flange 30, the zipper guide again hesitates while the spool 26 continues to rotate. Then the zipper guide again moves in the original direction, continuously displacing the incoming portion of the fastener tape 2 relative to the spool, so that the most recently wound portion of the fastener tape moves from the spool flange 30 toward the spool flange 28, such displacement continuing until the most recently wound portion of the fastener 2 tape is located adjacent or near the spool flange 28. This winding process continues until the spool is full, at which point the incoming portion of the fastener tape is cut and secured to the coil for transport or storage. Whenever the most recently wound portion of the fastener tape is within the central region and not within a predetermined distance of either spool, the tension in the incoming portion of the fastener tape is maintained within a first range. Conversely, whenever the most recently wound portion of the fastener tape is within the predetermined distance of either flange, the tension in the incoming portion of the fastener tape is maintained within a second range. In accordance with one embodiment of the present invention, the upper limit of the second tension range is less than the lower limit of the first tension range.

As the coil of tape builds up layers, the rotational speed of the spool can be appropriately adjusted to maintain the normal tension in the first range in the central area for all layers and maintain a reduced tension in the second range in the areas near the spool flanges for all layers. In other words, the annular volume in the center will be occupied by wound loops of tape under a normal tension in the first range, whereas the respective annular volumes adjacent the spool flanges (and distinct from the aforementioned central annular volume) will be occupied by wound loops of tape under a reduced tension in the second range.

In the disclosed embodiment, the winding tension in the fastener tape is changed by changing the speed at which fastener tape is moving through the zipper guide. At any stage in the winding process, the fastener tape speed can be changed by changing the speed at which the spool is rotating. Accordingly, to reduce the winding tension in the regions near the spool flanges, the rotational speed of the spool is reduced. When the winding fastener tape approaches the central area of the spool, where the winding tension need not be reduced, the rotational speed of the spool is then increased. Due to the inertia of the spool, changes in rotational speed necessarily occur gradually, yet quickly.

Alternatively, other means for controlling winding tension could be employed. For example, means could be provided for exerting a variable force on the incoming fastener tape that produces a variable resistance to pulling of the fastener tape by the rotating spool.

In the disclosed embodiment, the axial position of the incoming fastener tape is controlled by a reciprocating zipper guide. As the zipper guide is moved in a particular direction, the position where the incoming portion of the fastener tape first contacts the coil is displaced axially, so that the fastener tape is wound around the coil (or, initially, around the drum) in a helical or spiral fashion. Alternatively, other means for axially displacing the incoming portion of the fastener tape could be employed. For example, the zipper guide could be stationary while the spool reciprocates along its axis.

The winding methodology disclosed herein can be used during the winding of fastener tape following extrusion of two zipper strips, curing and the interlocking of the cured zipper strips. A method and an apparatus for making extruded separable zipper strips with reactivatable adhesive (comparable to the sealant layers referred to earlier with reference to the description of FIG. 1) is disclosed in U.S. Pat. No. 4,835,835. Because patent coverage is also being sought for the winding methodology used in conjunction with a continuous extrusion process, the steps of the latter process will now be discussed in summary fashion.

Extrapolating the teachings of U.S. Pat. No. 4,835,835, a compact two-orifice extrusion die, having one set of zipper strip orifices, can be adapted to produce a complete fastener assembly (i.e., tape). Preferred thermoplastic materials are polyethylene having a melting point in the range of 230 to 270 degrees F., polypropylene having a melting point on the order of 345 degrees F., and the like. The adhesive (i.e., sealant layer) is preferably applied to the zipper strip base surfaces during extrusion of the strips. In one useful mode the adhesive comprises a so-called hot melt adhesive selected from ethylene vinyl acetate, ethylene acrylic acid, polymer rubber resin blend, and the like, having a selected bonding fusion range of from 175 to 260 degrees F. The bonding fusion temperature of the adhesive should be sufficiently less than the melting point of the zipper strip material to which it is applied to permit the reaching of bonding fusion of the adhesive from a cold generally dormant condition, by application thereto of heat at a temperature which will not cause softening deformation or any other deterioration of the plastic material of the closure profiles. Conveniently, application of the adhesive to the base surfaces of the zipper strips is effected at the orifices of the extrusion die, and in a useful mode, by coextrusion through the orifices in the die. For this purpose, the adhesive in a fluent state is supplied for each of the zipper strips. The applied adhesive is carried along on the base surfaces as the extruded strips emerge from the die. Then the zipper strips pass to and through means defining a curing zone, such as a chilling chamber, in which the zipper strips are firmed and set, and the adhesive layers are concurrently set and cured to a dormant state on the base surfaces, but from which dormant state the adhesive can be reactivated later on for bonding to a web of packaging material. After leaving the curing chamber, the pair of complementary zipper strips can be assembled together by relatively reorienting the pairs of zipper strips as necessary (e.g., using guides and rollers) to achieve alignment of the closure profiles and then interengaging the closure profiles. Immediately downstream from this reorientation of the zipper strips, the complementary strips are pressed together as by means of pinch rolls into closed fastener assembly relation. These pinch rolls may be in contact with the nonsticky dormant adhesive on the base surfaces of the zipper strips. Downstream from the interlocking of the zipper strips, the continuously running fastener tape assemblies can be wound onto a spool of suitable size for subsequent handling and processing using the methodology for varying tape winding tension disclosed herein.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "ribbon" is meant to encompass both a single long continuous piece of material and a long assembly formed by attaching or interlocking two long continuous pieces of material together along their length (e.g., a fastener tape of the type used to make reclosable packaging on a machine). Also, in the absence of explicit language in any method claim setting forth the order in which certain steps should be performed, the method claims should not be construed to require that steps be performed in the order in which they are recited.

The invention claimed is:

1. A method of winding a length of plastic ribbon around a cylinder of a spool having a first flange at one end and a second flange at the other end, the first and second flanges being separated by a spool length, comprising the following steps:

(a) winding the ribbon with a winding tension in a first range when the portion of the ribbon being wound is within a first predetermined distance of the first flange;

(b) winding the ribbon with a winding tension in said first range when the portion of the ribbon being wound is within a second predetermined distance of the second flange; and (c) winding the ribbon with a winding tension in a second range when the portion of the ribbon being wound is not within a first predetermined distance of the first flange and not within a second predetermined distance of the second flange, wherein the sum of said first and second predetermined distances is less than said spool length, and the upper limit of said first range of winding tension is less than the lower limit of said second range of winding tension.

2. The method as recited in claim 1, wherein the ribbon comprises first and second zipper strips that are interlocked together.

3. The method as recited in claim 2, wherein each of the first and second zipper strips comprises a respective base web and a respective closure profile supported by the respective base web, the base webs lying generally parallel to the surface of the cylinder during winding.

4. The method as recited in claim 3, further comprising the steps of continuously extruding the first and second zipper strips, chilling each extruded portion of the first and second zipper strips, and then pressing the respective closure profiles of each extruded and chilled portion of the first and second zipper strips into interlocking engagement before that portion is wound on the spool.

5. The method as recited in claim 1, further comprising the steps of continuously extruding the plastic ribbon and then chilling each extruded portion of the plastic ribbon before that portion is wound on the spool.

6. The method as recited in claim 1, wherein during step (c) the ribbon is generally wound in a helical fashion.

7. A method of winding a length of plastic ribbon around a cylinder of a spool having a first flange at one end and a second flange at the other end, comprising the following steps:

(a) winding the ribbon with a winding tension in a first range when the portion of the ribbon being wound is within a first volume surrounding a central region of the cylinder;

(b) winding the ribbon with a winding tension in a second range when the portion of the ribbon being wound is within a second volume surrounding a portion of the cylinder disposed between the first flange and the central region; and (c) winding the ribbon with a winding tension in said second range when the portion of the ribbon being wound is within a third volume surrounding a portion of the cylinder disposed between the second flange and the central region, wherein the lower limit of said first range of winding tension is greater than the upper limit of said second range of winding tension.

8. The method as recited in claim 7, wherein the ribbon comprises first and second zipper strips that are interlocked together.

9. The method as recited in claim 8, wherein each of the first and second zipper strips comprises a respective base web and a respective closure profile supported by the respective base web, the base webs lying generally parallel to the surface of the cylinder during winding.

10. The method as recited in claim 9, further comprising the steps of continuously extruding the first and second zipper strips, chilling each extruded portion of the first and second zipper strips, and then pressing the respective closure profiles of each extruded and chilled portion of the first and second zipper strips into interlocking engagement before that portion is wound on the spool.

11. The method as recited in claim 7, further comprising the steps of continuously extruding the plastic ribbon and then chilling each extruded portion of the plastic ribbon before that portion is wound on the spool.

12. The method as recited in claim 7, wherein during step (a) the ribbon is generally wound in a helical fashion.

13. The method as recited in claim 7, wherein said steps are performed in the order (b), (a), (c), (a), (b).

14. A method of winding a length of plastic ribbon around a cylinder of a spool having a first flange at one end and a second flange at the other end, comprising the following steps:

(a) attaching an end of the ribbon to the spool so that a portion of the ribbon is disposed at a starting position on the cylinder;

(b) rotating the spool with the end of the ribbon attached thereto;

(c) while the spool is rotating, continuously displacing one of the incoming portion of the ribbon and the spool relative to the other so that the most recently wound portion of the ribbon moves relative to the spool from the starting position toward the first flange, such displacement continuing until the most recently wound portion of the ribbon is located adjacent or near the first flange;

(d) following step (c) and while the spool is rotating, continuously displacing one of the incoming portion of the ribbon and the spool relative to the other so that the most recently wound portion of the ribbon moves relative to the spool from the first flange toward the second flange, such displacement continuing until the most recently wound portion of the ribbon is located adjacent or near the second flange;

(e) following step (d) and while the spool is rotating, continuously displacing one of the incoming portion of the ribbon and the spool relative to the other so that the most recently wound portion of the ribbon moves relative to the spool from the second flange toward the first flange, such displacement continuing until the most recently wound portion of the ribbon is located adjacent or near the first flange, wherein steps (d) and (e) are repeated in alternating sequence during winding, and further comprising the following steps:

whenever the most recently wound portion of the ribbon is within a central region and not within a predetermined distance of either of the first and second flanges during steps (c), (d) and (e), maintaining the tension in the incoming portion of the ribbon within a first range; and whenever the most recently wound portion of the ribbon is within the predetermined distance of either of the first and second flanges during steps (c), (d) and (e), maintaining the tension in the incoming portion of the ribbon within a second range, the upper limit of said second tension range being less than the lower limit of said first tension range.

15. The method as recited in claim 14, wherein the tension in the incoming portion of the ribbon is varied by varying a resistance force that is applied to a portion of the ribbon disposed upstream of the incoming portion of the ribbon, said resistance force resisting but not preventing ribbon advancement.

16. The method as recited in claim 14, wherein the ribbon comprises first and second zipper strips that are interlocked together.

17. The method as recited in claim 16, wherein each of the first and second zipper strips comprises a respective base web and a respective closure profile supported by the respective base web, the base webs lying generally parallel to the surface of the cylinder during winding.

18. The method as recited in claim 17, further comprising the steps of continuously extruding the first and second zipper strips, chilling each extruded portion of the first and second zipper strips, and then pressing the respective closure profiles of each extruded and chilled portion of the first and second zipper strips into interlocking engagement before that portion is wound on the spool.

19. The method as recited in claim 14, further comprising the steps of continuously extruding the plastic ribbon and then chilling each extruded portion of the plastic ribbon before that portion is wound on the spool.

* * * * *